US009195202B2

(12) United States Patent
Choi

(10) Patent No.: US 9,195,202 B2
(45) Date of Patent: Nov. 24, 2015

(54) IMAGE FORMING APPARATUS, AND METHOD OF TRANSMITTING POWER AND METHOD OF MOUNTING DEVELOPING UNIT IN THE SAME

(71) Applicant: SAMSUNG ELECTRONICS CO., LTD., Suwon-si, Gyeonggi-do (KR)

(72) Inventor: Mun-hyub Choi, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 35 days.

(21) Appl. No.: 13/908,196

(22) Filed: Jun. 3, 2013

(65) Prior Publication Data

US 2014/0112679 A1 Apr. 24, 2014

(30) Foreign Application Priority Data

Oct. 24, 2012 (KR) ..... 10-2012-0118672

(51) Int. Cl.
*G03G 15/00* (2006.01)
*G03G 21/16* (2006.01)

(52) U.S. Cl.
CPC ..... *G03G 15/80* (2013.01); *G03G 21/1652* (2013.01); *G03G 21/1661* (2013.01); *G03G 2221/1684* (2013.01)

(58) Field of Classification Search
CPC ..... G03G 21/1864; G03G 21/1867
USPC ..... 399/90
See application file for complete search history.

(56) References Cited

U.S. PATENT DOCUMENTS

2007/0160380 A1 7/2007 Imaizumi et al.
2008/0279579 A1 11/2008 Kuruma
2008/0286993 A1 11/2008 Ito
2010/0239306 A1 * 9/2010 Souda ..... 399/107

FOREIGN PATENT DOCUMENTS

JP 7-77921 3/1995
JP 2008-276117 11/2008

OTHER PUBLICATIONS

Extended European Search Report mailed Feb. 6, 2014 in related European Application No. 13173417.0.

* cited by examiner

*Primary Examiner* — David Bolduc
*Assistant Examiner* — Barnabas Fekete
(74) *Attorney, Agent, or Firm* — Staas & Halsey LLP

(57) ABSTRACT

An image forming apparatus and method are provided. The apparatus includes a main body, a developing unit for forming an visible image, a transfer unit for transferring the visible image formed by the developing unit onto a recording medium, the transfer unit being disposed in the main body, a tray loaded with the developing unit and installed to be inserted or withdrawn into or from the main body, a power supply unit for supplying a power supply to the developing unit, the power supply unit being disposed in the main body, and a conductive member that is connected to the power supply unit, intersects an insertion or withdrawal direction of the tray, and directly contacts an electrical contact portion of the developing unit.

32 Claims, 9 Drawing Sheets

IMAGE FORMING APPARATUS, AND METHOD OF TRANSMITTING POWER AND METHOD OF MOUNTING DEVELOPING UNIT IN THE SAME

CROSS-REFERENCE TO RELATED APPLICATIONS

This application is related to, and claims priority to, Korean Patent Application No. 10-2012-0118672, filed on Oct. 24, 2012, in the Korean Intellectual Property Office, the disclosure of which is incorporated herein in its entirety by reference.

BACKGROUND

1. Field

Embodiments of the present invention relate to an image forming apparatus, a method of transmitting a power supply in the image forming apparatus, and a method of mounting a developing unit in the image forming apparatus, and more particularly, to an image forming apparatus in which a developing unit is mounted in a main body by using a tray method, a method of transmitting a power supply in the image forming apparatus, and a method of mounting a developing unit in the image forming apparatus.

2. Description of the Related Art

Image forming apparatuses form an image on a recording medium. Examples thereof include printers, copy machines, fax machines, and all-in-one devices that may implemented by combining functions, for example, of a printer, a copy machine, and a fax machine. In an electrophotographic image forming apparatus, light that is changed to correspond to image information may be irradiated to a photoconductor to form an electrostatic latent image on a surface of the photoconductor. Toner may be supplied to the electrostatic latent image to develop the electrostatic latent image into a visible toner image. The visible toner image is transferred and fixed onto a recording medium to thereby print an image on the recording medium. The electrophotographic image forming apparatus includes a developing unit in which toner is accommodated.

Toner may be provided in a form of a cartridge including a photoconductor, an electrifying roller, and a developing roller. The cartridge may be referred to as a developing unit. A bias voltage may be applied to the photoconductor, the electrifying roller, and the developing roller, included in the developing unit. An electrical contact for electrically connecting the developing unit with a power supply unit that may be disposed in a main body may be disposed in the developing unit.

When toner accommodated in the developing unit is entirely consumed, the developing unit may be removed from the image forming apparatus and a new developing unit mounted in the image forming apparatus. A method of inserting or withdrawing a tray into, or from, a main body after mounting a developing unit in the tray may be used to facilitate the replacement of the developing unit.

When a tray is not used, difficulties usually do not occur in applying a bias voltage to an electrical contact of a developing unit since the developing unit is directly mounted in a main body. However, when a tray is used, a component for connecting the electrical contact of the developing unit to a power supply unit disposed in the main body may be needed.

In addition, the developing unit may contact a transfer unit to print a visible toner image on a recording medium. When removing the developing unit when the developing unit contacts the transfer unit, care is necessary so as to not damage the transfer unit.

SUMMARY

Additional aspects and/or advantages will be set forth in part in the description which follows and, in part, will be apparent from the description, or may be learned by practice of the invention.

According to an exemplary embodiment of the present invention, an image forming apparatus that minimizes an increase in a number of components necessary for electrically bringing a developing unit into contact with a main body and that improves an electrical contact force is provided.

According to an exemplary embodiment of the present invention, a method of transmitting a power supply in the image forming apparatus is provided.

According to an exemplary embodiment of the present invention a method of mounting a developing unit in the image forming apparatus is provided.

According to an aspect of the present invention, an image forming apparatus includes a main body, a developing unit for forming an visible image, a transfer unit for transferring the visible image formed by the developing unit onto a recording medium, the transfer unit being disposed in the main body, a tray loaded with the developing unit and installed to be inserted into, or withdrawn from, the main body, a power supply unit for supplying a power supply to the developing unit, the power supply unit being disposed in the main body, and a single conductive member that is connected to the power supply unit, that intersects with an insertion, or withdrawal, direction of the tray, and directly contacts an electrical contact portion of the developing unit.

The main body may include a first guide for guiding the tray so that the tray is inserted into, or withdrawn from, the main body, and a second guide for guiding the tray so that the tray approaches or is spaced apart from the transfer unit.

The main body may include an opening through which the tray is inserted or withdrawn, and a door for opening or closing the opening.

The image forming apparatus may include an interlocking member that makes the door and the first guide interlock with each other.

During an opening or closing operation of the door, the first guide may be guided by the second guide and may be moved in a direction where the developing unit loaded in the tray approaches or is spaced apart from the transfer unit.

The conductive member may be elastically biased in a direction to bring the conductive member into contact with the electrical contact portion.

A connection hole may be formed in the tray so that the conductive member directly contacts the electrical contact portion.

A third guide for guiding the conductive member, so the conductive member may contract from the tray when inserting the tray into the main body, may be disposed on a front portion of the tray.

A fourth guide for guiding the conductive member, so the conductive member may contract from the tray when the conductive member is spaced apart from the electrical contact portion, may be disposed in an inside wall of the connection hole.

The tray may include a shutter unit for opening or closing the connection hole according to whether the developing unit is loaded in the tray.

The shutter unit may include a shutter plate that contacts the developing unit and opens the connection hole, and an elastic member that provides an elastic bias to the shutter plate in a direction to close the connection hole.

An area where the conductive member contacts the tray may have a round shape.

An area where the conductive member contacts the tray may be inclined with respect to the insertion and withdrawal direction of the tray.

According to an aspect of the present invention, a method of transmitting a power supply in an image forming apparatus is provided, the method including preparing a developing unit in which an electrical contact portion is disposed in at least one side thereof, preparing a main body that includes a transfer unit for transferring a visible image formed by the developing unit onto a recording medium, a power supply unit for supplying a power supply to the developing unit, and a single conductive member that is connected to the power supply unit, loading the developing unit in a tray so that the electrical contact portion of the developing unit is exposed, mounting the developing unit in the main body by moving the tray into the main body, and bringing the single conductive member into contact with the electrical contact portion of the developing unit when the mounting of the developing unit is completed.

The mounting of the developing unit may include inserting the tray into the main body along a first guide disposed in the main body, and making the developing unit approach the transfer unit by moving the first guide in a direction intersecting with a direction of the insertion of the tray along a second guide disposed in the main body.

The first guide may move along the second guide in connection with a closing operation of a door disposed in the main body.

The conductive member may be elastically biased in a direction to contact the electrical contact portion.

The conductive member may penetrate a connection hole formed in the tray to contact the electrical contact portion.

The conductive member may contract from the tray by a third guide disposed on a front portion of the tray when inserting the tray into the main body.

The conductive member may contract from the tray by a fourth guide disposed in an inside wall of the connection hole when the conductive member is spaced from the electrical contact portion.

A shutter unit disposed in the tray may close the connection hole when the developing unit is not mounted in the tray, and may open the connection hole when the developing unit is mounted in tray.

An area where the conductive member contacts the tray may have a round shape.

An area where the conductive member contacts the tray may be inclined with respect to the insertion and withdrawal direction of the tray.

According to an aspect of the present invention, a method of mounting a developing unit in an image forming apparatus is provided, the method including preparing a developing unit in which an electrical contact portion is disposed in at least one side thereof, preparing a main body that includes a transfer unit for transferring a visible image formed by the developing unit onto a recording medium, a power supply unit for supplying a power supply to the developing unit, and a single conductive member that is connected to the power supply unit, loading the developing unit in a tray so that the electrical contact portion of the developing unit is exposed, and bringing the single conductive member into contact with the electrical contact portion of the developing unit by moving the tray into the main body.

The bringing of the single conductive member into contact with the electrical contact portion may include inserting the tray into the main body along a first guide disposed in the main body, making the developing unit approach the transfer unit by moving the first guide in a direction intersecting with a direction of the insertion of the tray along a second guide disposed in the main body, and bringing the single conductive member into contact with the electrical contact portion when the approaching of the developing unit to the transfer unit is completed.

The first guide may move along the second guide in connection with a closing operation of a door disposed in the main body.

The conductive member may be elastically biased in a direction to contact the electrical contact portion.

The conductive member may penetrate a connection hole formed in the tray to contact the electrical contact portion.

The conductive member may contract from the tray by a third guide disposed on a front portion of the tray when inserting the tray into the main body.

The conductive member may contract from the tray by a fourth guide disposed in an inside wall of the connection hole when the conductive member is spaced from the electrical contact portion.

A shutter unit disposed in the tray may close the connection hole when the developing unit is not mounted in the tray, and may open the connection hole when the developing unit is mounted in tray.

An area where the conductive member contacts the tray may have a round shape.

An area where the conductive member contacts the tray may be inclined with respect to the insertion and withdrawal direction of the tray.

According to an image forming apparatus according to an embodiment of the present invention, a method of transmitting a power supply in the image forming apparatus, and a method of mounting a developing unit in the image forming apparatus, a contact defect due to the increase of components for electrical contact may be prevented by using a single conductive member between a power supply unit of a main body and an electrical contact portion of a developing unit. In addition, it is possible to prevent the conductive member from being damaged in an insertion or withdrawal process of a tray by improving the shape of the tray and the shape and disposition of the conductive member.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

Exemplary embodiments are described with reference to the accompanying drawings. Expressions such as "at least one of," when preceding a list of elements, modify the entire list of elements and do not necessarily modify the individual elements of the list.

Figure 1:
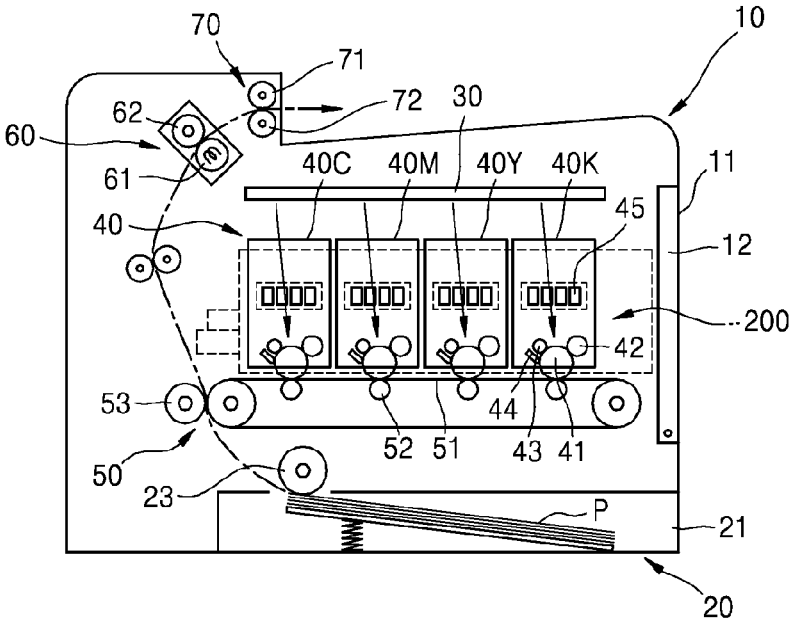
FIG. 1 illustrates an image forming apparatus according to an embodiment of the present invention.

FIG. 1 illustrates an image forming apparatus according to an exemplary embodiment of the present invention.

Referring to FIG. 1, the image forming apparatus includes a main body 10, a paper feeding unit 20, a light scanning unit 30, a developing unit 40, a transfer unit 50, a fusing unit 60, and a discharge unit 70.

The main body 10 may support various components mounted in the main body 10. An opening 11 may be formed in at least one side of the main body 10, and a door 12 for opening or closing the opening 11 may be disposed in the main body. 10. A user may replace or repair a component, or may remove a recording medium jammed in the main body 10, through the opening 11.

The paper feeding unit 20 feeds recording media P to the developing unit 40. The paper feeding unit 20 includes a cassette 21 that may be detachably mounted in the main body 10. The recording media P are stacked on the cassette 21, and may be picked up on a sheet basis by a pickup roller 23 during a printing operation. A recording medium P picked up by the pickup roller 23 may be transferred to the transfer unit 50 or the developing unit 40.

The light scanning unit 30 forms an electrostatic latent image by radiating light corresponding to image information, which is input from the outside, onto a photoconductor 41. In a color image forming apparatus, the light scanning unit 30 may be configured to radiate light corresponding to yellow (Y), magenta (M), cyan (C), and black (K) onto the photoconductor 41.

The developing unit 40 may include four developing units 40C, 40M, 40Y, and 40K in which yellow (Y) developer, magenta (M) developer, cyan (C) developer, and black (K) developer are accommodated, respectively. The photoconductor 41 may be disposed in each of the developing units 40C, 40M, 40Y, and 40K.

Each of the developing units 40C, 40M, 40Y, and 40K may include an electrifying roller 43 for electrifying the photoconductor 41, a developing roller 42 for forming a visible image by supplying a developer to the electrostatic latent image formed on the photoconductor 41, and a cleaning member 44 for removing the developer remaining on the photoconductor 41 after transferring. The developing unit 40 includes a plurality of electrical contact portions 45 through which a voltage is applied to the photoconductor 41, the electrifying roller 43, the developing roller 42, and the cleaning member 44, respectively.

The transfer unit 50 transfers the visible image formed on the photoconductor 41 onto the recording medium P. The transfer unit 50 includes an intermediate transfer belt 51, four intermediate transfer rollers 52 for transferring a visible image formed on each photoconductor 41 onto the intermediate transfer belt 51, and a final transfer roller 53 for transferring a toner image on the intermediate transfer belt 51 onto the recording medium P. A voltage having a polarity opposite to the polarity of a developer attached on each photoconductor 41 may be applied to each of the four intermediate transfer rollers 52, and thus, the visible image on the photoconductor 41 may be transferred onto the intermediate transfer belt 51.

The fusing unit 60 includes a heat unit 61 and a press roller 62. The fusing unit 60 applies heat and pressure to the recording medium P passing between the heat unit 61 and the press roller 62, and thus fixes a non-fused image on the recording medium P to the recording medium P.

The discharge unit 70 discharges the recording medium P passing through the fusing unit 60 to the outside of the image forming apparatus. The discharge unit 70 includes a discharge roller 71 and a discharge backup roller 72 that is installed opposite to the discharge roller 71.

The developing unit 40 may be replaced with a new developing unit when a developer included therein is entirely consumed. The developing unit 40 may be loaded in a tray 200 that is movably installed in the main body 10, and thus may be combined with, or separated from, the main body 10. In a process of mounting or withdrawing the developing unit 40 in, or from, the main body 10 through the tray 200, a contact between the developing unit 40 and the transfer unit 50 should be considered.

As illustrated in FIG. 1, a contact between the photoconductor 41 and the transfer unit 50 may be required to form an image on the recording medium P. However, the photoconductor 41 or the transfer unit 50 may be damaged when withdrawing the tray 200, in which the developing unit 40 has been loaded, from the main body 10 when the photoconductor 41 contacts the transfer unit 50.

Figure 2:
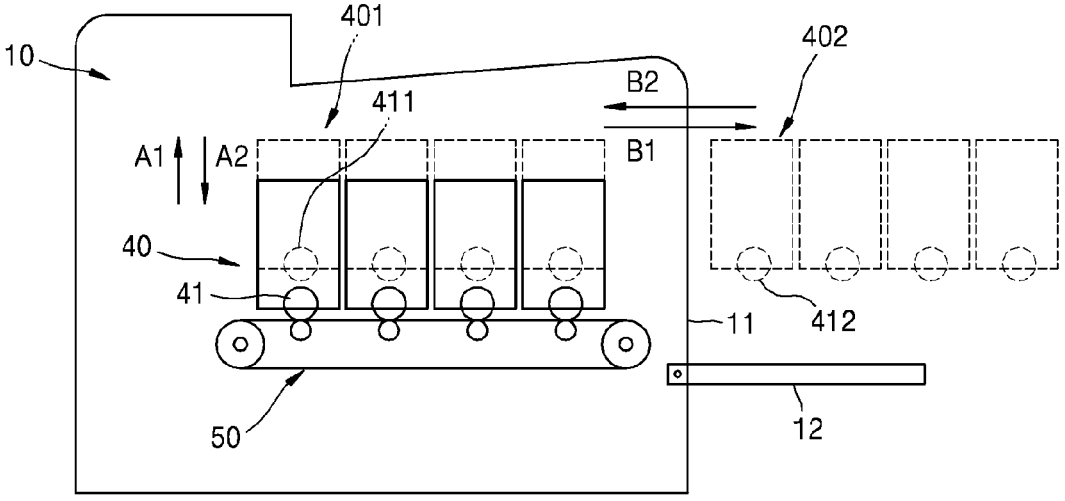
FIG. 2 illustrates a location of a developing unit in a process of inserting or separating the developing unit into, or from, a main body in an image forming apparatus.

FIG. 2 illustrates a location of the developing unit 40 in a process of inserting or separating the developing unit 40 into, or from, the main body 10 in an image forming apparatus. In FIG. 2, for convenience of explanation, the photoconductor 41 of the developing unit 40 and the transfer unit 50 are illustrated and the other components, such as the tray, for example, tray 200, are not illustrated.

As illustrated in FIG. 2, in a process of separating the photoconductor 41 of the developing unit 40 from the transfer unit 50 or making a photoconductor 411 of a developing unit 401 approach the transfer unit 50 to combine them with each other, the developing unit 40 or 401 may be transferred through a first path or a second path not to damage the photoconductor 41 or 411 or the transfer unit 50.

The first path may be a path of a direction in which the photoconductor 41 of the developing unit 40 is spaced apart from the transfer unit 50, for example, a direction A1 in which the photoconductor 41 of the developing unit 40 rises, or may be a path of a direction in which the photoconductor 411 of the developing unit 401 approaches the transfer unit 50, for example, a direction A2 in which the photoconductor 411 of the developing unit 401 descends. Through the first path, the photoconductor 41 or 411 of the developing unit 40 or 401 may be spaced apart from, or approach, the transfer unit 50 disposed in the main body 10.

The second path may be a path of a direction B1 in which the developing unit 401 is withdrawn from the main body 10 or may be a path of direction B2 in which a developing unit 402 is inserted into the main body 10. Through the second path, the photoconductor 411 or 412 of the developing unit 401 or 402 may be withdrawn to the outside of the main body 10 or inserted into the main body 10 in the state where the developing unit 401 or 402 is spaced apart from the transfer unit 50.

Thus, the developing unit 40 may be stably separated from, or combined with, the main body 10 without damage to the photoconductor 41 or the transfer unit 50.

Figure 3A:
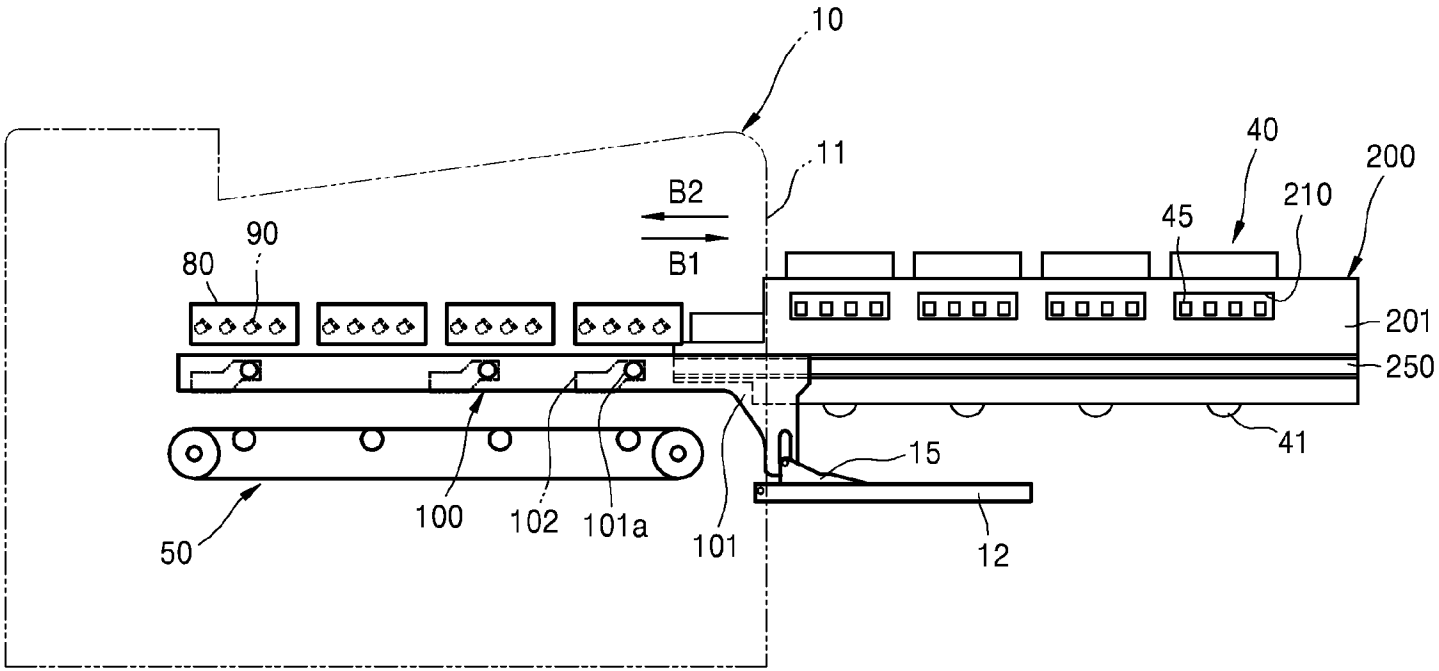
FIGS. 3A through 3C are views illustrating a tray movably installed in the main body in an image forming apparatus.
Figure 3B:
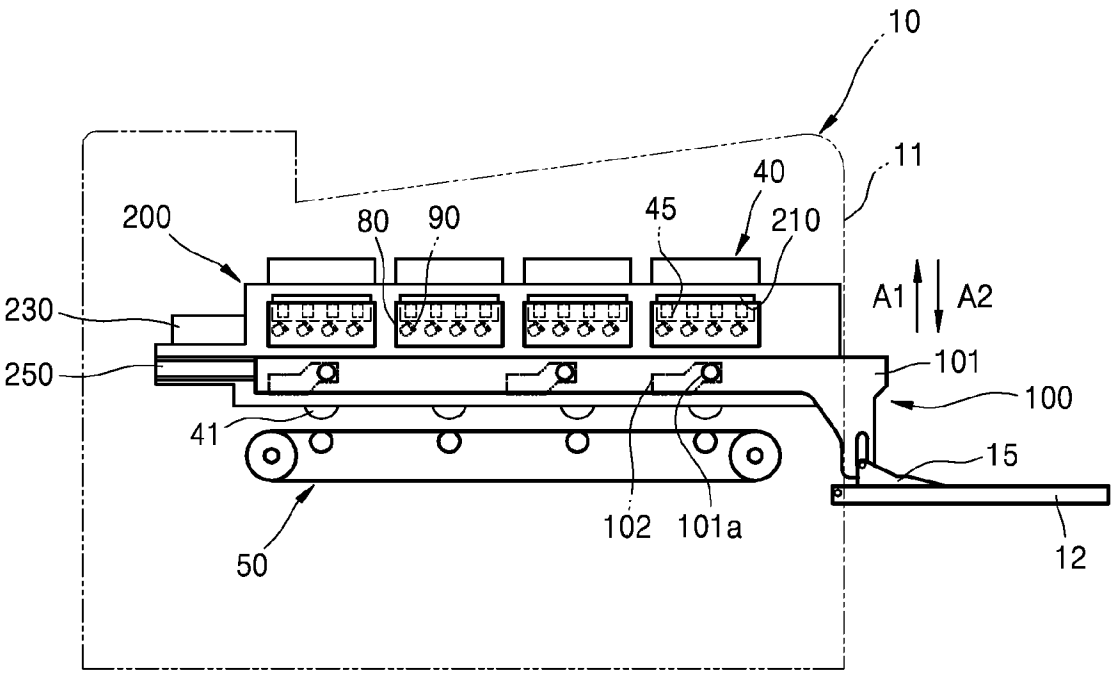
Figure 3C:
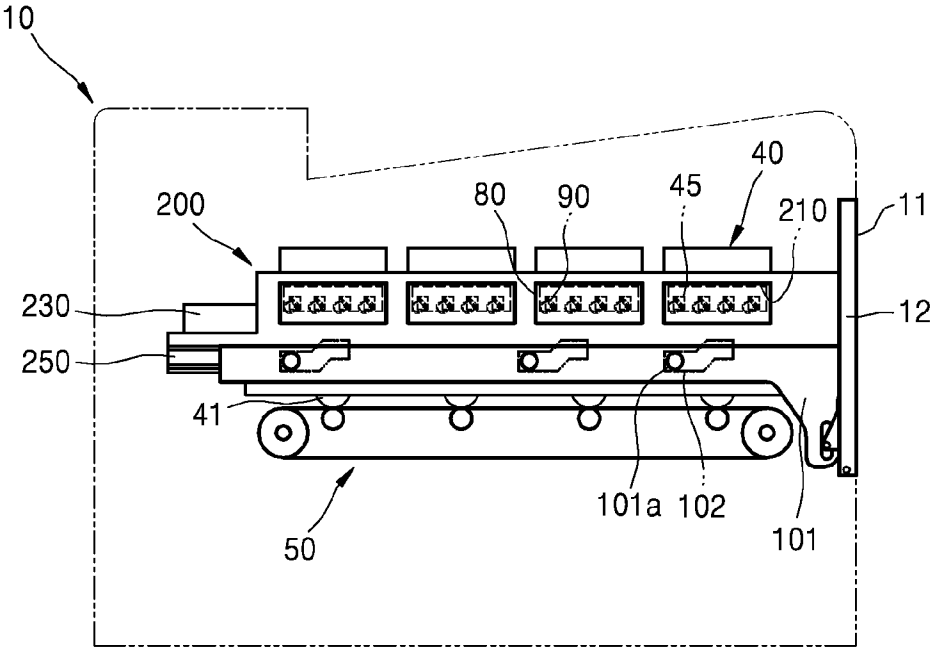

FIGS. 3A through 3C illustrate an exemplary state in which tray 200 may be movably installed in the main body 10 in an image forming apparatus.

In accordance with an exemplary embodiment, to implement a transfer path of the developing unit 40 illustrated in FIG. 2, a tray guide unit 100 for guiding the tray 200 loaded with the developing unit 40 may be disposed in the main body 10. The tray guide unit 100 may include a first guide 101 and a second guide 102.

As illustrated in FIG. 3A, the tray 200 may be slidably combined with the first guide 101, and the insertion and withdrawal of the tray 200 may be guided by the first guide 101. As the tray 200 moves along the first guide 101, the developing unit 40 loaded in the tray 200 may be transferred in the second path. For a sliding combination between the tray 200 and the first guide 101, a rail 250 may be formed on the exterior of the tray 200 so that the tray 200 moves along the first guide 101. The tray 200 may be transferred along the first guide 101, and thus is inserted into the main body 10 as illustrated in FIG. 3B.

In an exemplary state where the tray 200 is inserted into the main body 10 along the first guide 101 as illustrated in FIG. 3B, the tray 200 may transfer the developing unit 40 loaded in the tray 200 in the first path by using the second guide 102. For example, where the tray 200 is slidably combined with the first guide 101, the tray 200 that is slidably combined with the first guide 101 may be moved as the first guide 101 is moved along the second guide 102. The second guide 102 may guide the developing unit 40 mounted in the tray 200 so that the developing unit 40 approaches or is spaced apart from the transfer unit by moving the first guide 101 in a direction intersecting with the direction of the insertion or withdrawal of the tray 200, for example, in a descending or rising direction of the tray 200. In order for the second guide 102 to guide the first guide 101, the second guide 102 may be formed separate from the first guide, as illustrated in FIG. 3A. For example, the second guide 102 may have a guide groove shape in which a protrusion part 101*a* formed on the exterior of the first guide 101 is inserted into the second guide 102. The movement of the first guide 101 may be guided according to the guide groove shape when an external force is applied to the first guide 101 when the protrusion part 101*a* is inserted into the second guide 102. For example, as illustrated in FIG. 3C, the second guide 102 may also guide the tray 200 combined with the first guide 101 in a descending direction by guiding the first guide 101 in the descending direction. Thus, the developing unit 40 loaded in the tray 200 may approach the transfer unit 50 along the first path. The tray 200 may be moved together with the first guide 101 during a rising or lowering movement of the first guide 101, but is not influenced by back or forth movement of the first guide 101. Thus, the tray 200 may move along the first path in the rising or descending direction without a back or forth movement that is not like the shape of the second guide 102.

An external force that is applied to the first guide 101 may be transmitted by using various methods. For example, the external force may be transmitted in connection with the door 12. The first guide 101 may be connected to the door 12 by an interlocking member 15. When applying a force to the door 12 in a direction to close the opening 11, the first guide 101 may receive a force in a direction towards the inside of the main body 10 by an interlocking member 15 connected to the door 12, and thus, the first guide 101 moves in the inside of the main body 10 along the second guide 102. As the movement of the first guide 101 is guided by the second guide 102, the tray 200 that is slidably combined with the first guide 101 is guided together with the first guide 101 by the second guide 102. Thus, the tray 200 that is slidably combined with the first guide 101 is guided so that the tray 200 approaches the transfer unit 50. Alternatively, when applying a force to the door 12 in a direction to open the opening 11, the first guide 101 may receive a force in a direction towards the outside of the main body 10 by the interlocking member 15 connected to the door 12, and thus, the first guide 101 moves towards the outside of the main body 10 along the second guide 102. As the movement of the first guide 101 is guided by the second guide 102, the tray 200 that is slidably combined with the first guide 101 is guided to be spaced apart from the transfer unit 50.

According to an exemplary embodiment, in a process of movably installing the tray 200 in the main body 10 so that the tray 200 approaches, or is spaced apart, from the transfer unit 50, a power supply may be controlled between the developing unit 40 loaded in the tray 200 and a power supply unit 80 installed in the main body 10. In a process of installing the tray 200 in the main body 10, or where the tray 200 has been installed in the main body 10, an electrical connection relation between the developing unit 40 loaded in the tray 200 and the power supply unit 80 installed in the main body 10 disclosed.

The power supply unit 80 may be installed in the main body 10 and supply power to the developing unit 40 through a conductive member 90.

Figure 5:
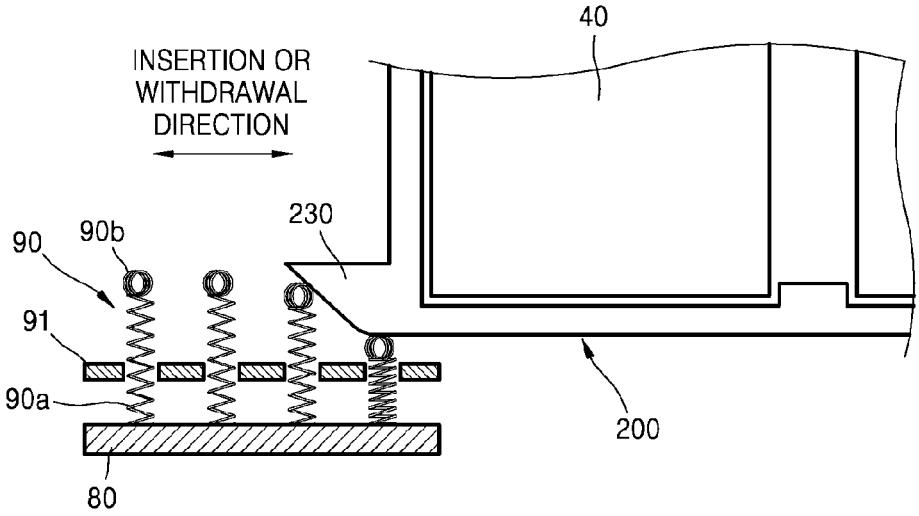
FIG. 5 is a schematic plan view illustrating a tray inserted into a main body.

One end 90*a* of the conductive member 90 may be connected to the power supply unit 80, and the other end 90*b* (as illustrated in FIG. 5) of the conductive member 90 may intersect with the insertion or withdrawal direction of the tray 200. The conductive member 90 may be supported by a fixing member 91 installed in the main body 10. The conductive member 90 contacts a sidewall 201 of the tray 200 when the tray 200 is inserted or withdrawn along the first path as illustrated in FIG. 3B, and directly contacts the electrical contact portions 45 of the developing unit 40 when the tray 200 moves along the second path and thus reaches the transfer unit 50 as illustrated in FIG. 3C.

Figure 4:
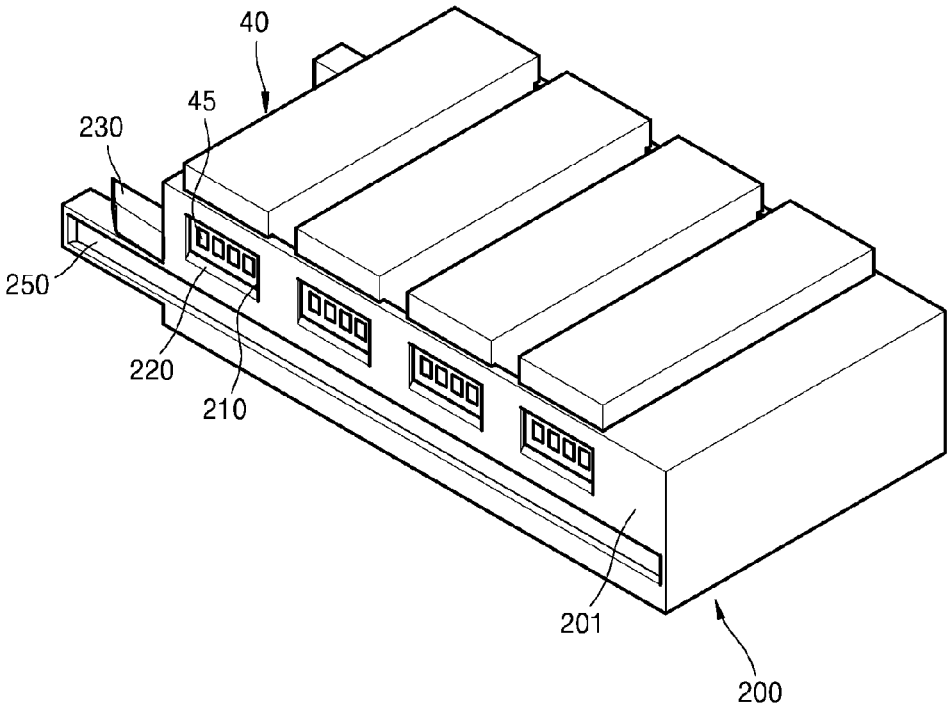
FIG. 4 is a schematic perspective view illustrating a tray loaded with a developing unit in an image forming apparatus.

FIG. 4 illustrates an exemplary tray 200 loaded with the developing unit 40 in the image forming apparatus.

As illustrated in FIG. 4, the developing unit 40 may be loaded in the tray 200, and a connection hole 210 where the electrical contact portions 45 of the developing unit 40 are exposed may be formed in the sidewall 201 of the tray 200. A third guide 230 for enabling the conductive member 90 to contract from the tray 200 may be disposed in the front portion of the tray 200, and a fourth guide 220 for enabling the conductive member 90 to contract from the tray 200 may be disposed in an inside wall of the connection hole 210.

Figure 6:
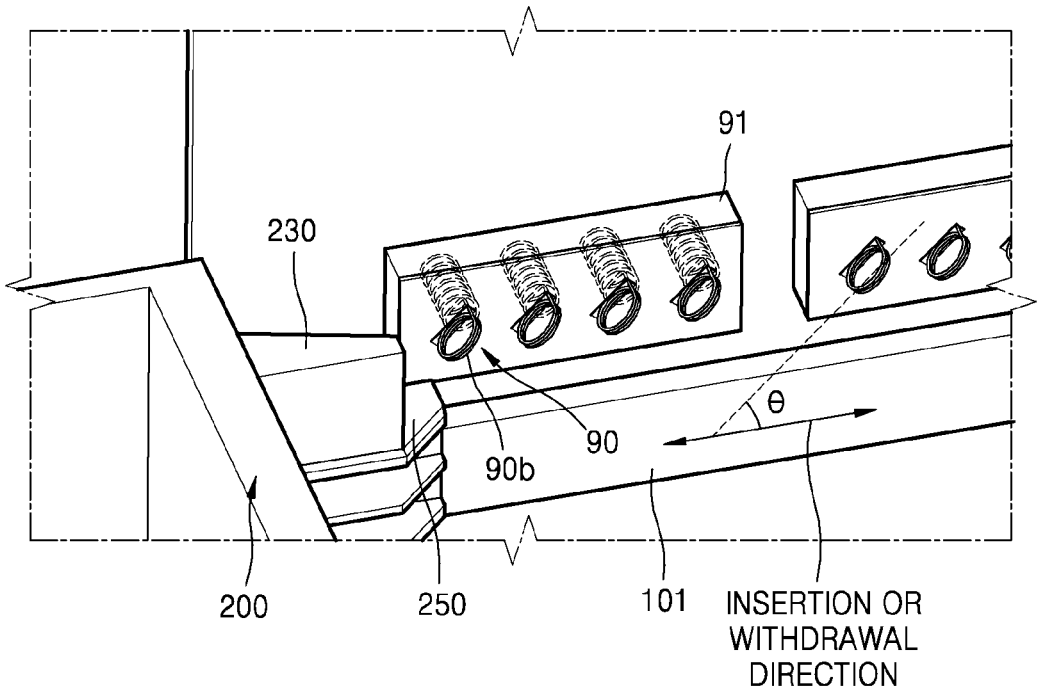
FIG. 6 is a schematic internal perspective view illustrating a tray inserted into the main body.

FIG. 5 illustrates a tray 200 inserted into the main body 10. FIG. 6 illustrates an exemplary tray 200 as illustrated, for example, in FIG. 4, inserted into the main body 10.

As illustrated in FIG. 5, the power supply unit 80 disposed in the main body 10 may be connected to the end 90*a* of the conductive member 90, and the other end 90*b* of the conductive member 90 intersects with the insertion or withdrawal direction of the tray 200. The conductive member 90 may be elastically biased in a direction to bring the conductive member 90 into contact with an electrical contact portion 45 formed in the developing unit 40. The tray 200 loaded with the developing unit 40 may be inserted into the main body 10 when the other end 90*b* of the conductive member 90 intersects with the insertion or withdrawal direction of the tray 200. In a process in which the tray 200 is inserted into the main body 10, the third guide 230 of the tray 200 provides an inclined plane that allows the conductive member 90 to be loosed from the tray 200. Through the inclined plane, it is possible to enable the conductive member 90 to be loosed in a stable manner from the tray 200 while gradually changing a pressure that is applied to the other end 90*b* of the conductive member 90. The third guide 230 may guide the elastic restoration of the conductive member 90 in a process in which the tray 200 is withdrawn.

As illustrated in FIG. 5, the power supply unit 80 disposed in the main body 10 may be connected to the end 90*a* of the conductive member 90, and the other end 90*b* of the conductive member 90 intersects with the insertion or withdrawal direction of the tray 200. The conductive member 90 may be elastically biased in a direction to bring the conductive member 90 into contact with an electrical contact portion 45 formed in the developing unit 40. The tray 200 loaded with the developing unit 40 may be inserted into the main body 10 when the other end 90*b* of the conductive member 90 intersects with the insertion or withdrawal direction of the tray 200. In a process in which the tray 200 is inserted into the main body 10, the third guide 230 of the tray 200 provides an inclined plane that allows the conductive member 90 to contract from the tray 200. Through the inclined plane, it is possible to enable the conductive member 90 to contract in a stable manner from the tray 200 while gradually changing a pressure that is applied to the other end 90*b* of the conductive member 90. The third guide 230 may guide the elastic restoration of the conductive member 90 in a process in which the tray 200 is withdrawn.

The conductive member 90 contracted by the third guide 230 may contact the sidewall 201 of the tray 200. An area of the conductive member 90 that contacts the sidewall 201 of the tray 200, for example, the other end 90*b* of the conductive member 90, may have a round shape. Thus, the other end 90*b* of the conductive member 90 may be prevented from being damaged in a transfer process of the tray 200. To minimize a contact area with the tray 200 in the transfer process of the tray 200, as illustrated in FIG. 6, the other end 90*b* of the conductive member 90 may be disposed to be inclined with respect to the insertion and withdrawal direction of the tray 200. For example, the disposition direction of the other end 90*b* of the conductive member 90 may be at a predetermined angle θ with the insertion and withdrawal direction of the tray 200.

Figure 7A:
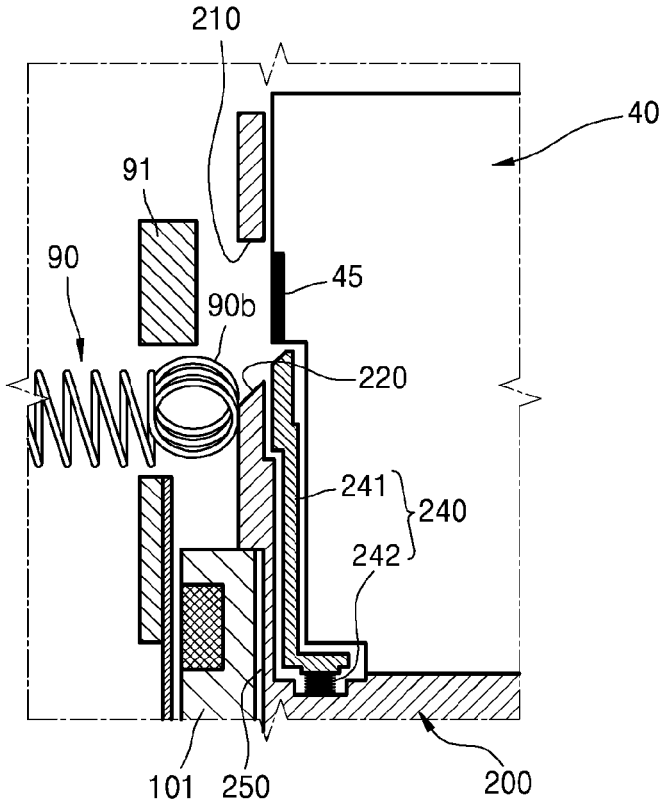
FIGS. 7A through 7C illustrate a contact relation between a conductive member and an electrical contact portion of a developing unit according to the movement of the tray in the image forming apparatus.

FIG. 7A illustrates positions of the tray 200 and the conductive member 90 while the tray 200 is transferred in the first path through the first guide 101. The conductive member 90 may be elastically biased in a direction to bring the conductive member 90 into contact with the electrical contact portion 45 of the developing unit 40 loaded in the tray 200. As illustrated in FIG. 7A and FIG. 3B, since the position of the conductive member 90 and the position of the electrical contact portion 45 may be different from each other, the conductive member 90 contacts the sidewall 201 of the tray 200 and not the electrical contact portion 45. For example, the conductive member 90 may be positioned below the electrical contact portion 45, and thus contacts the sidewall 201 of the tray 200 positioned below the connection hole 210.

Figure 7B:
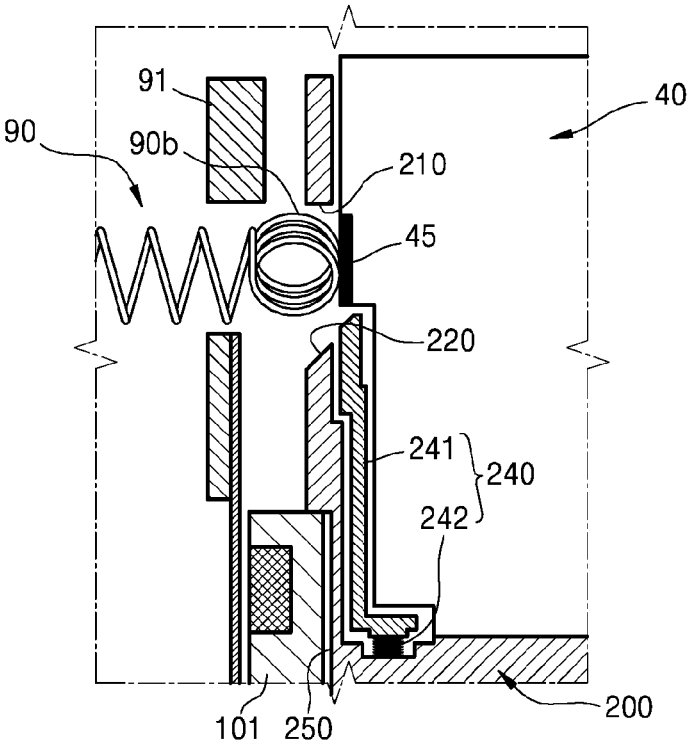

FIG. 7B illustrates tray 200 lowered through the second guide 102. As illustrated in FIGS. 7B and 3C, when the tray 200 is guided through the second guide 102 and thus a lowering of the tray 200 is completed, the developing unit 40 of the tray 200 contacts the transfer unit 50. A connection hole 210 formed in the tray 200 may be positioned at the same position as the conductive member 90 according to a lowering of the tray 200, and the conductive member 90 that is elastically biased in the direction to bring the conductive member 90 into contact with the electrical contact portion 45 is inserted into the connection hole 210. The conductive member 90 inserted into the connection hole 210 penetrates the connection hole 210, and thus contacts the electrical contact portion 45 of the developing unit 40. Thus, a power supply required by the developing unit 40 is applied.

Figure 7C:
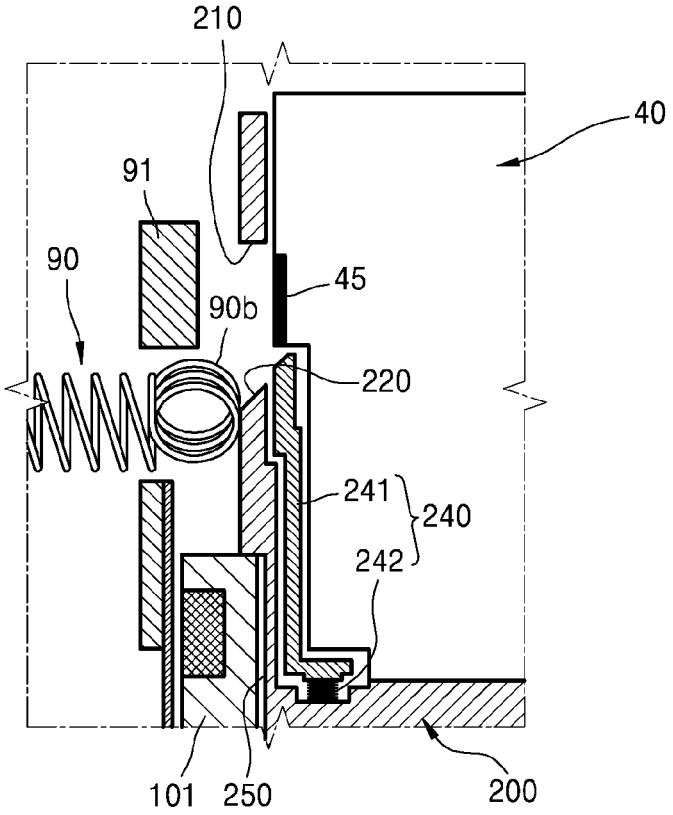
Figure 8:
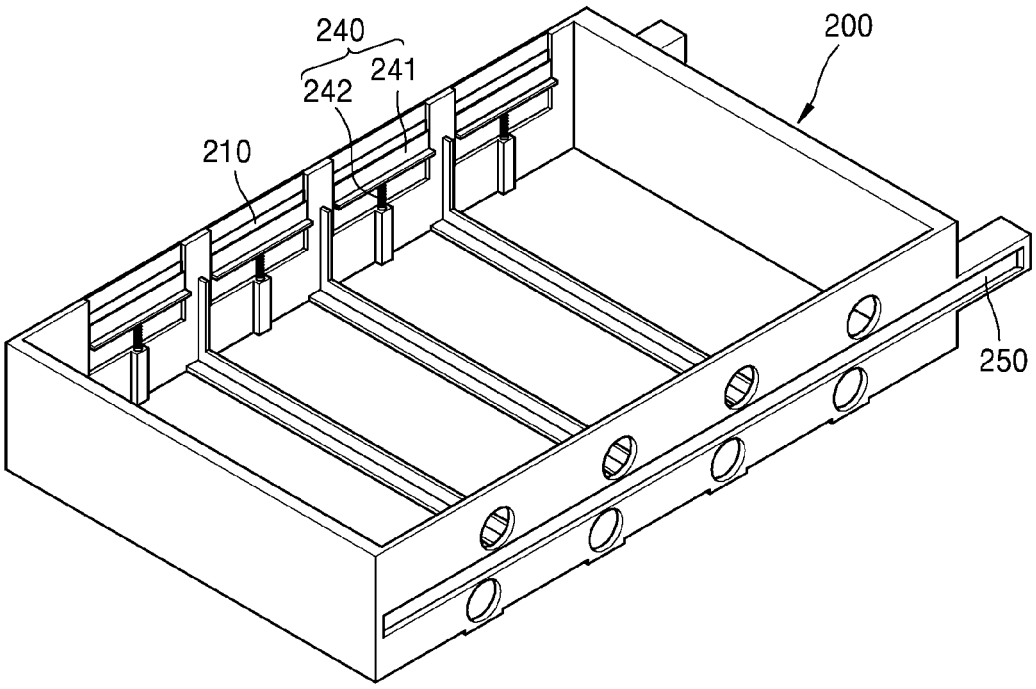
FIG. 8 is a schematic perspective view illustrating the tray installed with a shutter unit in the image forming apparatus.
Figure 9:
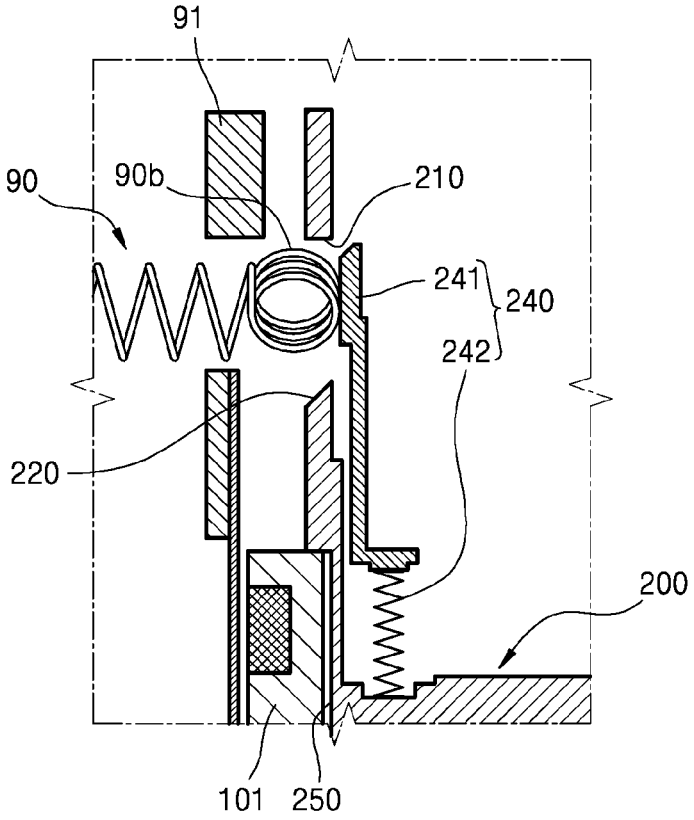
FIG. 9 is a schematic view illustrating an operation state of the shutter unit in the tray of the image forming apparatus.

FIG. 7C illustrates tray 200 raised through the second guide 102. To have the developing unit 40 of the tray 200 be spaced apart from the transfer unit 50, the tray 200 may be raised along the second guide 102. The electrical contact portion 45 of the developing unit 40 may be spaced apart from the conductive member 90 in the process of raising the tray 200. When the conductive member 90 is spaced apart from the electrical contact portion 45, the conductive member 90 may be loosed from the tray 200 along the fourth guide 220 formed in an inside wall of the connection hole 210. The fourth guide 220 may prevent the conductive member 90 from being bent or damaged while the conductive member 90 goes through the connection hole 210. In addition, the fourth guide 220 may act as a guide so that the conductive member 90 is inserted into the connection hole 210 when the tray 200 descends.

FIG. 7C illustrates tray 200 raised through the second guide 102. To have the developing unit 40 of the tray 200 be spaced apart from the transfer unit 50, the tray 200 may be raised along the second guide 102. The electrical contact portion 45 of the developing unit 40 may be spaced apart from the conductive member 90 in the process of raising the tray 200. When the conductive member 90 is spaced apart from the electrical contact portion 45, the conductive member 90 contracts from the tray 200 along the fourth guide 220 formed in an inside wall of the connection hole 210. The fourth guide 220 may prevent the conductive member 90 from being bent or damaged while the conductive member 90 goes through the connection hole 210. In addition, the fourth guide 220 may act as a guide so that the conductive member 90 is inserted into the connection hole 210 when the tray 200 descends.

The tray 200 may include the shutter unit 240 for opening or closing the connection hole 210 according to whether the developing unit 40 is accommodated. The shutter unit 240 prevents the conductive member 90 from being inserted into the connection hole 210 when the developing unit 40 is not loaded in the tray 200. The shutter unit 240 may include a shutter plate 241 for opening or closing the connection hole 210 and an elastic member 242 for providing an elastic bias in a direction to open the connection hole 210, for example, a direction in which the shutter plate 241 is raised. When the developing unit 40 is not loaded in the tray 200, the shutter plate 241 may be raised by the elastic member 242 and thus the connection hole 210 is blocked. When the developing unit 40 is loaded in the tray 200, the developing unit 40 contacts the shutter plate 241 as illustrated in FIG. 7A through 7C and thus the connection hole 210 is opened by making the shutter plate 241 descend. Accordingly, although the tray 200 is installed in the main body 10 in the state where the developing unit 40 is not loaded in the tray 200, it is possible to prevent the conductive member 90 from being damaged.

While exemplary embodiments of the present are particularly shown and described with reference to exemplary embodiments thereof, the embodiments are exemplary. For example, although the embodiments described relate to a color image forming apparatus for forming a color image by using cyan (C), magenta (M), yellow (Y), and black (K)

toners, the present invention is not limited thereto. An image forming apparatus according to According to an exemplary embodiment of the present invention may be applied to an image forming apparatus for forming an image on a recording medium by using various methods, such as an image forming apparatus using a single color toner. In addition, although in the embodiments described above, the transfer unit 50 is disposed at a relatively lower position and the developing unit 40 is disposed at a relatively higher position, the position of the transfer unit 50 and the position of the developing unit 40 may be exchanged with each other. In addition, although in the embodiments described above, the connection hole 210 has a rectangular shape as an example. According to an exemplary embodiment of the present invention is not limited thereto. The connection hole 210 may have any shape by which the electrical contact portion 45 may be exposed, and for example, may have a shape in which an upper portion is cut open.

Those of ordinary skill in the art understand that various changes in form and details may be made therein without departing from the spirit and scope of the present invention.

What is claimed is:

1. An image forming apparatus comprising:
- a main body;
- a developing unit for forming an image;
- a transfer unit for transferring the image formed by the developing unit onto a recording medium, the transfer unit being disposed in the main body;
- a tray loaded with the developing unit and installed so as to be inserted into, or withdrawn from, the main body;
- a power supply unit for supplying power to the developing unit, the power supply unit being disposed in the main body; and
- a conductive member that is connected to the power supply unit, intersects with an insertion or withdrawal direction of the tray, and directly contacts an electrical contact portion of the developing unit,
- wherein a connection hole is formed in the tray so that the conductive member directly contacts the electrical contact portion.

2. The image forming apparatus of claim 1, wherein the main body comprises:
- a first guide for guiding the tray so that the tray is inserted into, or withdrawn from, the main body, and
- a second guide for guiding the tray so that the tray approaches or is spaced apart from the transfer unit.

3. The image forming apparatus of claim 2, wherein the main body further comprises:
- an opening through which the tray is inserted or withdrawn, and
- a door for opening or closing the opening.

4. An image forming apparatus comprising:
- a main body;
- a developing unit for forming an image;
- a transfer unit for transferring the image formed by the developing unit onto a recording medium, the transfer unit being disposed in the main body;
- a tray loaded with the developing unit and installed so as to be inserted into, or withdrawn from, the main body;
- a power supply unit for supplying power to the developing unit, the power supply unit being disposed in the main body;
- a conductive member that is connected to the power supply unit, intersects with an insertion or withdrawal direction of the tray, and directly contacts an electrical contact portion of the developing unit; and
- an interlocking member that makes the door and the first guide interlock with each other,
- wherein the main body comprises:
  - a first guide for guiding the tray so that the tray is inserted into, or withdrawn from, the main body,
  - a second guide for guiding the tray so that the tray approaches or is spaced apart from the transfer unit,
  - an opening through which the tray is inserted or withdrawn, and
  - a door for opening or closing the opening.

5. The image forming apparatus of claim 4, wherein during an opening or closing operation of the door, the first guide is guided by the second guide and is moved in a direction where the developing unit loaded in the tray approaches or is spaced apart from the transfer unit.

6. The image forming apparatus of claim 1, wherein the conductive member is elastically biased in a direction to bring the conductive member into contact with the electrical contact portion.

7. The image forming apparatus of claim 1, wherein a third guide, for guiding the conductive member so the conductive member contracts from the tray when inserting the tray into the main body, is disposed on a front portion of the tray.

8. The image forming apparatus of claim 1, wherein a fourth guide, for guiding the conductive member so the conductive member contracts from the tray when the conductive member is spaced apart from the electrical contact portion, is disposed in an inside wall of the connection hole.

9. The image forming apparatus of claim 1, wherein the tray further comprises a shutter unit for opening or closing the connection hole according to whether the developing unit is loaded in the tray.

10. The image forming apparatus of claim 9, wherein the shutter unit comprises:
- a shutter plate that contacts the developing unit and opens the connection hole, and
- an elastic member that provides an elastic bias to the shutter plate in a direction to close the connection hole.

11. The image forming apparatus of claim 6, wherein an area where the conductive member contacts the tray has a round shape.

12. The image forming apparatus of claim 6, wherein an area where the conductive member contacts the tray is inclined with respect to the insertion and withdrawal direction of the tray.

13. A method of transmitting a power supply in an image forming apparatus, the method comprising:
- preparing a developing unit in which an electrical contact portion is disposed in at least one side thereof;
- preparing a main body that comprises a transfer unit for transferring a image formed by the developing unit onto a recording medium, a power supply unit for supplying power to the developing unit, and a conductive member that is connected to the power supply unit;
- loading the developing unit in a tray so that the electrical contact portion of the developing unit is exposed;
- mounting the developing unit in the main body by moving the tray into the main body; and
- bringing the conductive member into contact with the electrical contact portion of the developing unit when the mounting of the developing unit is completed,
- wherein the conductive member penetrates a connection hole formed in the tray to contact the electrical contact portion.

14. The method of claim 13, wherein the mounting of the developing unit comprises:

inserting the tray into the main body along a first guide disposed in the main body, and making the developing unit approach the transfer unit by moving the first guide in a direction intersecting with a direction of the insertion of the tray along a second guide disposed in the main body.

15. A method of transmitting a power supply in an image forming apparatus, the method comprising:

preparing a developing unit in which an electrical contact portion is disposed in at least one side thereof;

preparing a main body that comprises a transfer unit for transferring a image formed by the developing unit onto a recording medium, a power supply unit for supplying power to the developing unit, and a conductive member that is connected to the power supply unit;

loading the developing unit in a tray so that the electrical contact portion of the developing unit is exposed;

mounting the developing unit in the main body by moving the tray into the main body; and bringing the conductive member into contact with the electrical contact portion of the developing unit when the mounting of the developing unit is completed, wherein the mounting of the developing unit comprises:

inserting the tray into the main body along a first guide disposed in the main body, and making the developing unit approach the transfer unit by moving the first guide in a direction intersecting with a direction of the insertion of the tray along a second guide disposed in the main body, wherein the first guide moves along the second guide in connection with a closing operation of a door disposed in the main body.

16. The method of claim 13, wherein the conductive member is elastically biased in a direction to contact the electrical contact portion.

17. The method of claim 13, wherein the conductive member contracts from the tray by a third guide disposed on a front portion of the tray when inserting the tray into the main body.

18. The method of claim 13, wherein the conductive member contracts from the tray by a fourth guide disposed in an inside wall of the connection hole when the conductive member is spaced from the electrical contact portion.

19. The method of claim 13, wherein a shutter unit disposed in the tray closes the connection hole when the developing unit is not mounted in the tray, and opens the connection hole when the developing unit is mounted in tray.

20. The method of claim 16, wherein an area where the conductive member contacts the tray has a round shape.

21. The method of claim 16, wherein an area where the conductive member contacts the tray is inclined with respect to the insertion and withdrawal direction of the tray.

22. A method of mounting a developing unit in an image forming apparatus, the method comprising:

preparing a developing unit in which an electrical contact portion is disposed in at least one side thereof;

preparing a main body that comprises a transfer unit for transferring a image formed by the developing unit onto a recording medium, a power supply unit for supplying power to the developing unit, and a conductive member that is connected to the power supply unit;

loading the developing unit in a tray so that the electrical contact portion of the developing unit is exposed; and bringing the conductive member into contact with the electrical contact portion of the developing unit by moving the tray into the main body, wherein the conductive member penetrates a connection hole formed in the tray to contact the electrical contact portion.

23. The method of claim 22, wherein the bringing of the single conductive member into contact with the electrical contact portion comprises:

inserting the tray into the main body along a first guide disposed in the main body, making the developing unit approach the transfer unit by moving the first guide in a direction intersecting with a direction of the insertion of the tray along a second guide disposed in the main body, and bringing the single conductive member into contact with the electrical contact portion when the approaching of the developing unit to the transfer unit is completed.

24. A method of mounting a developing unit in an image forming apparatus, the method comprising:

preparing a developing unit in which an electrical contact portion is disposed in at least one side thereof;

preparing a main body that comprises a transfer unit for transferring a image formed by the developing unit onto a recording medium, a power supply unit for supplying power to the developing unit, and a conductive member that is connected to the power supply unit;

loading the developing unit in a tray so that the electrical contact portion of the developing unit is exposed; and bringing the conductive member into contact with the electrical contact portion of the developing unit by moving the tray into the main body, wherein the bringing of the single conductive member into contact with the electrical contact portion comprises:

inserting the tray into the main body along a first guide disposed in the main body, making the developing unit approach the transfer unit by moving the first guide in a direction intersecting with a direction of the insertion of the tray along a second guide disposed in the main body, and bringing the single conductive member into contact with the electrical contact portion when the approaching of the developing unit to the transfer unit is completed, wherein the first guide moves along the second guide in connection with a closing operation of a door disposed in the main body.

25. The method of claim 22, wherein the conductive member is elastically biased in a direction to contact the electrical contact portion.

26. The method of claim 25, wherein the conductive member contracts from the tray by a third guide disposed on a front portion of the tray when inserting the tray into the main body.

27. The method of claim 25, wherein the conductive member contracts from the tray by a fourth guide disposed in an inside wall of the connection hole when the conductive member is spaced from the electrical contact portion.

28. The method of claim 25, wherein a shutter unit disposed in the tray closes the connection hole when the developing unit is not mounted in the tray, and opens the connection hole when the developing unit is mounted in tray.

29. The method of claim 25, wherein an area where the conductive member contacts the tray has a round shape.

30. The method of claim 25, wherein an area where the conductive member contacts the tray is inclined with respect to the insertion and withdrawal direction of the tray.

31. A tray to accommodate a developing unit for an image forming apparatus, the tray comprising:

a connection hole allowing a conductive member to make contact with an electrical source; and a shutter unit for opening or closing the connection hole based on whether the developing unit is accommodated.

32. The tray according to claim 31, wherein the shutter unit comprises:

a shutter plate for opening or closing the connection hole, and an elastic member for providing an elastic bias to the shutter plate.

* * * * *